US006126389A

United States Patent [19]

Burdgick

[11] Patent Number: 6,126,389

[45] Date of Patent: Oct. 3, 2000

[54] IMPINGEMENT COOLING FOR THE SHROUD OF A GAS TURBINE

[75] Inventor: Steven Sebastian Burdgick, Schenectady, N.Y.

[73] Assignee: General Electric Co., Schenectady, N.Y.

[21] Appl. No.: 09/145,683

[22] Filed: Sep. 2, 1998

[51] Int. Cl.[7] ..... F01D 5/14

[52] U.S. Cl. ..... 415/115; 415/117; 415/173.1

[58] Field of Search ..... 415/115, 116, 415/117, 173.1, 173.2, 175, 176, 178

[56] References Cited

U.S. PATENT DOCUMENTS

| | | | |
|---|---|---|---|
| 4,317,646 | 3/1982 | Steel et al. | 415/116 |
| 5,350,277 | 9/1994 | Jacala et al. . | |
| 5,391,052 | 2/1995 | Correia et al. | 415/115 |
| 5,480,281 | 1/1996 | Correia . | |

*Primary Examiner*—Edward K. Look
*Assistant Examiner*—Liam McDowell
*Attorney, Agent, or Firm*—Nixon & Vanderhye

[57] ABSTRACT

An inner shroud 22 is coupled to an outer shroud 20 which receives cooling air through an inlet 54 for flow to the inner shroud. The inner shroud includes a wall 42 which defines in part the hot gas path 16 and a plurality of cavities 44 on an opposite side of the wall. The inner shroud includes a cover 40 having depending compartments 52 with apertures 56 through the floor of the compartments. When the cover overlies the inner shroud body, the compartments are received in the cavities and cooling air from the inlet flows into the compartments and through the apertures for impingement cooling of the inner shroud wall. Spent cooling air exits the inner shroud through passages 45 through circumferential and/or axial facing side walls of the inner shroud and/or the wall of the inner shroud defining the hot gas path.

18 Claims, 4 Drawing Sheets

IMPINGEMENT COOLING FOR THE SHROUD OF A GAS TURBINE

TECHNICAL FIELD

The present invention relates to impingement cooling apparatus for a shroud system surrounding the rotating components in the hot gas path of a gas turbine and particularly relates to inner and outer shroud segments employing a feed of cooling air directly into the inner shroud body for impingement cooling of the inner shroud wall surface opposite the wall surface surrounding the hot gas path.

BACKGROUND OF THE INVENTION

Shrouds employed in gas turbines surround and in part define the hot gas path through the turbines. Systems for cooling the shrouds, particularly those directly surrounding the rotating parts, i.e., the gas turbine buckets or blades, in the hot gas path of the gas turbine are oftentimes necessary in gas turbines to reduce the temperature of the surrounding shrouds. Shrouds are typically characterized by a plurality of circumferentially extending shroud segments arranged about the hot gas path with each segment including discrete inner and outer shroud bodies. Conventionally, there are two or three inner shroud bodies for each outer shroud body, with the outer shrouds being secured by dovetail-type connections to the frame of the turbine and the inner shroud bodies being secured by similar dovetail connections to the outer shroud bodies.

The inner shroud body includes a wall which in part defines the hot gas path and which must be cooled, for example, with cooling air from the compressor discharge of the turbine. In prior designs, an impingement plate has been provided in the outer shroud body for receiving the cooling air and directing the cooling air through apertures in the plate for impingement cooling of the inner shroud body wall. This arrangement is not optimum from the standpoint of efficient cooling and requires substantial cooling flow. More particularly, the impingement plate mounted on the outer shroud body in this conventional design is spaced a substantial distance from the wall being cooled by the impingement air flow through the apertures of the plate. The inner shroud body has axially extending reinforcing or structural ribs projecting radially outwardly from the wall being cooled, previously believed to necessitate the location of the impingement plate mounted to the outer shroud a substantial distance from that wall. With this arrangement, cooling efficiency is lost as the impingement cooling air flows over this very substantial distance before impacting and cooling the inner shroud wall. Further, by locating the impingement plate in the outer shroud body, the impingement cooling air sees secondary leakage paths prior to passing through the impingement plate apertures, which causes further inefficiencies in cooling and requires additional cooling flow. Thus, there is a need for an impingement cooling system which will substantially reduce these cooling inefficiencies, eliminate leakage paths and substantially reduce the impingement flow distance between the impingement plate and the inner shroud body wall being cooled by the impingement cooling air flow.

BRIEF SUMMARY OF THE INVENTION

According to the present invention, there is provided an impingement cooling apparatus for a shroud system surrounding rotating components in the hot gas path of a turbine and which system employs a plurality of shroud segments each comprising an outer shroud segment and one or more inner shroud segments secured to the outer shroud segment. The inner shroud segment mounts an impingement plate in a manner which eliminates leakage paths between the outer shroud segment and impingement plate and locates the impingement plate directly adjacent the inner shroud segment wall being cooled by the impingement air flow, thereby affording efficient impingement cooling. Particularly, the inner shroud segment includes an inner shroud segment body having a bottom wall, the radially innermost surface of which in part defines the hot gas path through the turbine. One or more cavities are provided in the inner shroud body on a side thereof remote from the wall surface defining the hot gas path. The inner shroud segment also includes a cover for overlying the inner shroud body. The cover has one or more depending closed compartments for reception in the respective cavities of the plate. The cover is secured to the inner shroud body by welding, brazing or the like, with the one or more compartments lying in respective cavities. An air inlet opens through the cover in communication with an air inlet passageway through the body of the outer shroud segment for supplying cooling air to the compartments. The bottom wall of each compartment has a plurality of apertures for flowing cooling air received in the compartment directly onto and hence impingement cooling the bottom walls or floors of the cavities defining in part the hot gas path. Passages through the inner shroud body lie in communication with the space between the compartments and the cavities for exhausting the spent cooling flow into the hot gas stream.

Where the inner shroud body has two or more cavities, the cavities are defined by radially outwardly projecting structural ribs which extend between the compartments of the cover, thereby maintaining the structural integrity of the inner shroud body. At least one or more compartments with corresponding registering cavities are preferred and preferably two or four compartments with corresponding cavities are most preferred. Four cavities are used if a circumferential rib is needed for stiffening. The ribs of the inner shroud body in the latter preferred embodiment extend axially, radially and circumferentially, thereby maintaining the structural integrity of the plate. By locating the cooling compartments in the cavities and securing the cover to the inner shroud body, not only are leakage paths between the outer shroud body and the cover eliminated, but the distance between the apertures and the wall being cooled is minimized, thereby affording efficient impingement cooling.

Preferably, the air inlet passages to the compartments of the cover of the inner shroud segment are provided with a spoolie which can be disposed in a passageway formed through the outer shroud body. The spoolie is coupled at its inner end to a nipple forming an air inlet for the inner shroud segment cover. It will be appreciated that by changing the size of the spoolie or pipe sizes used in lieu of spoolies, the magnitude of the air flow into the inner shroud body for impingement cooling purposes can be controlled, for example, when performing turbine retrofits in the field during downtime.

In a preferred embodiment according to the present invention, there is provided impingement cooling apparatus for a shroud system surrounding components rotatable about an axis in the hot gas path of a turbine, comprising a shroud segment forming part of a shroud for surrounding the rotating components of the turbine, the shroud segment including a shroud segment body having a circumferentially extending wall, in part, defining the hot gas path, a plurality of cavities on a side of the segment body remote from the hot gas path and a cover for the shroud segment body having a cooling air inlet and a plurality of radially inwardly projecting compartments in communication with the air inlet and received in the cavities, respectively, each compartment having a bottom wall in spaced registration with the wall of the segment body and having a plurality of impingement apertures opening therethrough for flowing impingement cooling air from the compartments through the apertures and against the segment body wall for cooling the segment body wall and at least one passage through the segment body in communication with the space between the segment body wall and the bottom gas path wall for flowing spent cooling air from the segment body.

In a further preferred embodiment according to the present invention, there is provided impingement cooling apparatus for a shroud system surrounding components rotatable about an axis in the hot gas path of a turbine, comprising an inner shroud segment forming part of the shroud system for surrounding the rotating components of the turbine, the inner shroud segment including an inner shroud body having a circumferentially and axially extending wall defining in part the hot gas path, at least four cavities formed in the inner shroud body on a side thereof remote from the hot gas path with radial innermost portions of the cavities formed by portions of the inner shroud body wall and a cover having a cooling air inlet and a plurality of radially inwardly projecting closed compartments in communication with the inlet for receiving cooling air, the compartments being received in the cavities, respectively, the compartments having bottom walls in spaced registration with the inner shroud body wall portions and a plurality of impingement apertures through each of the bottom walls for flowing impingement cooling air from the compartments against the inner shroud body wall portions for cooling the shroud body wall, and at least one passage in communication with each of the cavities and opening externally of the inner shroud body for flowing spent cooling air from the cavities.

In a still further preferred embodiment according to the present invention, there is provided impingement cooling apparatus for a shroud system surrounding components rotatable about an axis in the hot gas path of a turbine, comprising an inner shroud segment forming part of the shroud system for surrounding the rotating components of the turbine, the inner shroud segment including an inner shroud body having a circumferentially and axially extending wall defining in part the hot gas path, at least one cavity formed in the inner shroud body on a side thereof remote from the hot gas path and opening radially outwardly, radial innermost portions of one cavity being formed by portions of the inner shroud body wall, and a cover having a cooling air inlet and at least one radially inwardly projecting closed compartment in communication with the inlet for receiving cooling air, one compartment being received in one cavity, one compartment having a bottom wall in spaced registration with the inner shroud body wall portions and a plurality of impingement apertures through the bottom wall for flowing impingement cooling air from one compartment against the inner shroud body wall portions for cooling the shroud body wall, and at least one passage in communication with the cavity and opening externally of the inner shroud body for flowing spent cooling air from the cavity.

Accordingly, it is a primary object of the present invention to provide a novel and improved impingement cooling apparatus for the shroud of a gas turbine wherein impingement cooling efficiencies are maximized by eliminating leakage paths for the cooling inlet flow to the inner shroud segment and minimizing the distance of impingement flow between the impingement plate apertures and the wall surface being cooled.

DETAILED DESCRIPTION OF THE INVENTION

Figure 1:
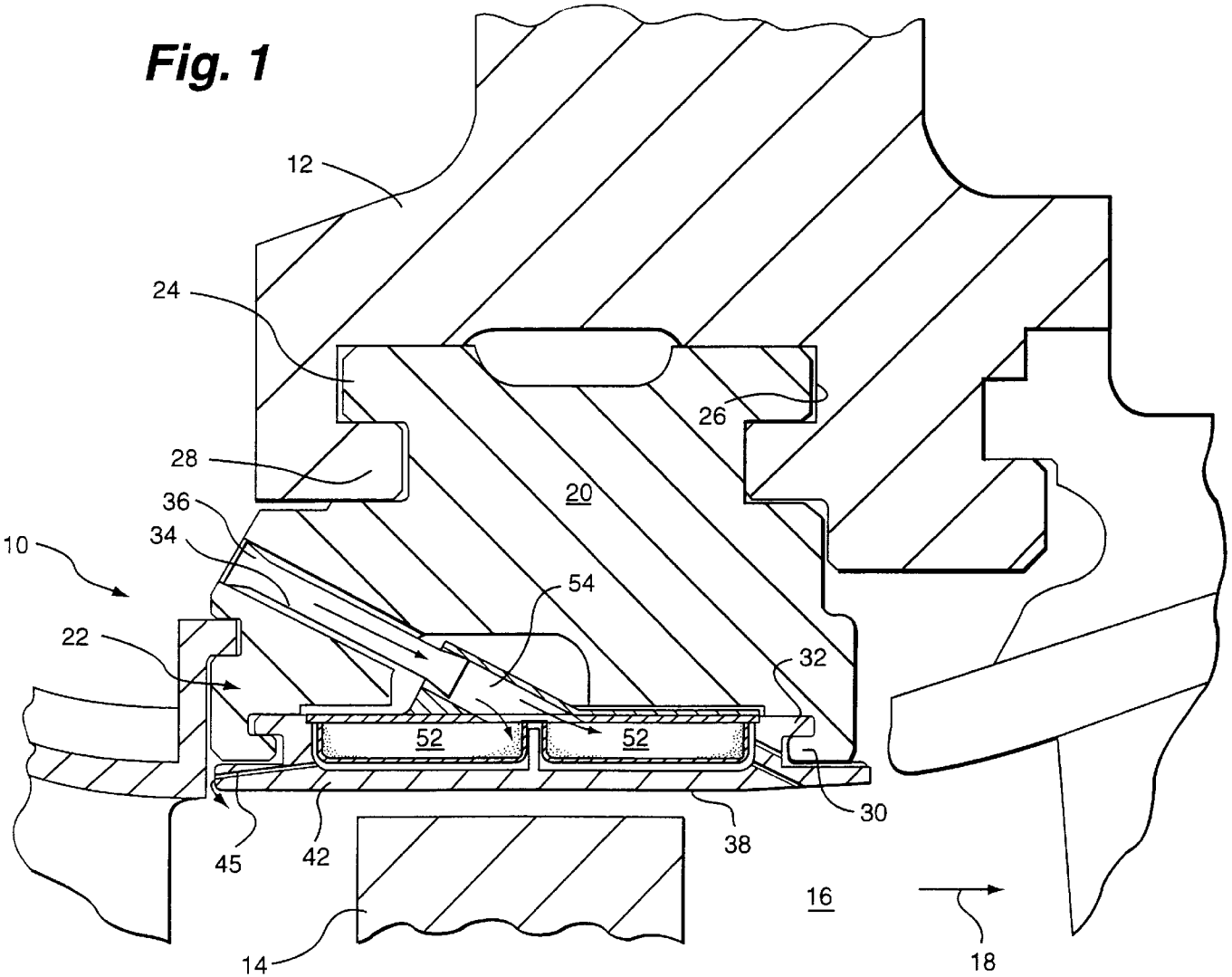
FIG. 1 is a fragmentary cross-sectional view of a portion of a gas turbine illustrating a first stage shroud system surrounding the rotating components in the hot gas path of the turbine.

Referring now to FIG. 1, there is illustrated a shroud system for surrounding the rotating components in the hot gas path of a turbine and which shroud system is generally designated 10. Shroud system 10 is secured to a stationary frame 12 of a turbine housing and surrounds the rotating buckets or vanes 14 disposed in the hot gas path 16 of the turbine, shroud system 10 for the first stage of the turbine being illustrated. The direction of flow of the hot gas is indicated by the arrow 18. The shroud system 10 includes outer and inner shroud segments, generally designated 20 and 22, respectively. It will be appreciated that the shroud system includes a plurality of such segments arranged circumferentially relative to one another with two or three inner shroud segments 22 connected to each of the outer shroud segments 20. For example, there may be on the order of forty-two outer shroud segments circumferentially adjacent.one another and eighty-four inner shroud segments circumferentially adjacent one another, with each pair of inner shroud segments being secured to an outer shroud segment.

Each outer shroud segment 20 preferably has a pair of axially extending flanges 24 and an axially reduced neck portion 26 forming a dovetail connection with locating flanges or hooks 28 formed on the stationary frame 12. Thus, the outer shroud segments 20 can be fitted to the frame 12 in a circumferential direction for securement thereto. Radially inner portions of the outer shroud segment 20 define locating hooks 30 extending axially toward one another. Inner shroud segment 22 has axially projecting flanges 32 which cooperate with the hooks 30 to secure the inner shroud segments 22 to the outer shroud segments 20.

The outer shroud segment 20 also includes a passageway 34 for receiving cooling air, for example, compressor discharge air. A spoolie 36 is disposed in passage 34 for transmitting the cooling air into compartments of the inner shroud segment as described below.

Figure 3:
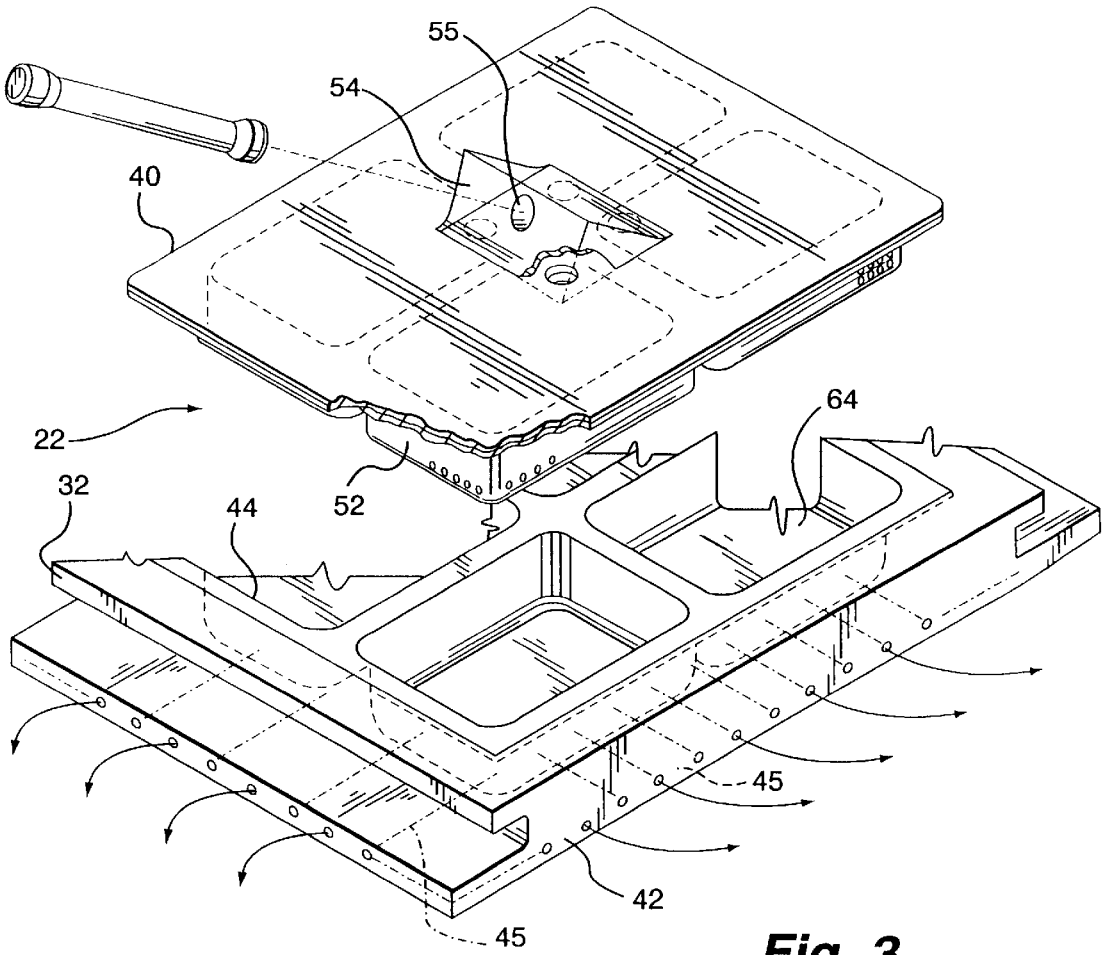
FIG. 3 is a fragmentary exploded perspective view of an inner shroud segment illustrating details of the inner shroud body and cover.
Figure 4:
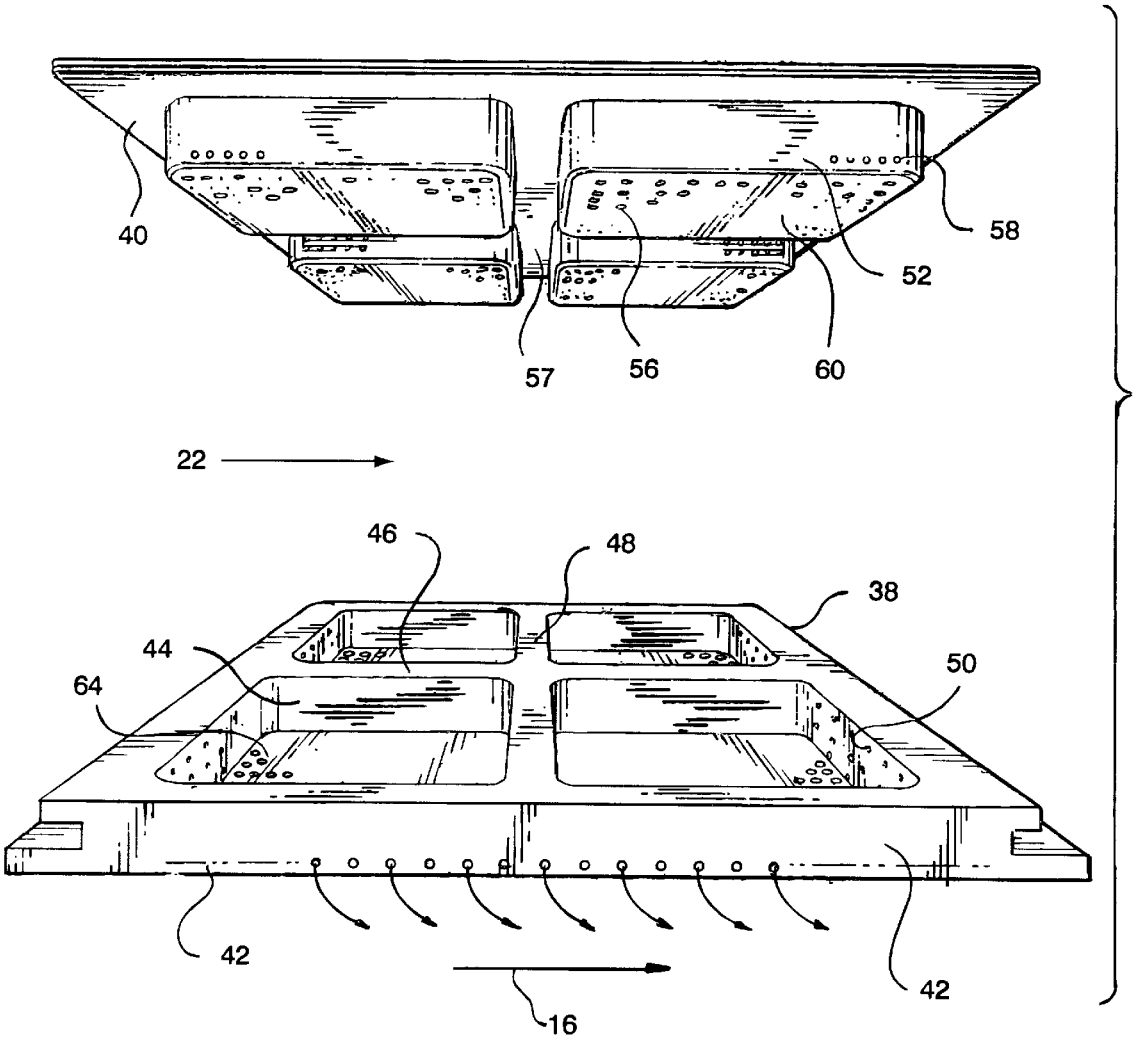
FIG. 4 is an exploded perspective view of the inner shroud body and cover therefor.

Referring to FIGS. 3 and 4, the inner shroud segment 22 includes an inner shroud segment body 38 and a cover 40. Inner shroud segment body 38 extends axially and circumferentially and includes a radially inner circumferentially and axially extending wall 42 defining in part the hot gas path 16 flowing past the rotating components, i.e., buckets 14. Body 38 also includes a plurality of cavities 44 formed in the radially outermost wall surface of body 38. Cavities 44 are defined by radially outwardly projecting structural ribs 46 and 48, the ribs 46 extending axially, while the ribs 48 extend circumferentially. As illustrated in FIG. 4, the cavities 44 have a plurality of exit openings along side wall portions thereof for flowing spent cooling air through passages 45 opening through the outer walls of the body 38 for egress into the hot gas path 16. The openings 50 through the side walls of the cavity thus communicate with openings in the circumferentially and axially extending faces of the inner shroud body 38 radially inwardly of seals, not shown, between the inner shroud bodies and between the inner shroud bodies and outer shroud bodies.

The inner shroud body cover 40 carries a plurality of depending compartments 52. The compartments lie in communication with a plenum 54 located along the radially outermost surface of cover 40 and which plenum lies in communication with the inner end of the spoolie 36 via plenum inlet 55 for receiving cooling air. Plenum 54 also lies in communication through openings in the cover with each of the compartments 52. Each of the compartments 52 has a plurality of apertures 56 through bottom walls 60 of compartments 52, the compartments 52 being otherwise closed except for plenum inlet 55 and apertures 56. Compartments 52 are spaced from one another to define recesses 57 therebetween for receiving the ribs 46 and 48 when the cover 40 overlies the inner shroud body 38. Additional apertures 58 are provided through corner portions of the compartments 52. Thus, when the cover 40 overlies the body 38, the compartments 52 reside in cavities 44 with the ribs 46 and 48 extending in the recesses 57 between the respective compartments. The depth of the compartments is such that the bottom walls 60 and hence the apertures 56 therethrough lie in close spaced relation to the wall portions or floors 64 of the cavities 44.

In operation, cooling air is supplied to the spoolie 36, which in turn supplies the air to plenum 54 via inlet 55 and compartments 52 via openings through the cover into compartments 52. The cooling air flows through the impingement apertures 56 of compartments 52 for impingement cooling against the floors 64 of the cavities lying on the opposite side of the inner shroud body from the hot gas path 16, thus cooling the radially innermost wall 42 of the inner shroud segments. Additional impingement cooling air flow flows through the corner apertures 58 of compartments 52 and against the side walls (corners) of the cavities 44. The spent cooling air flows out of the cavities 44 through the apertures 50 and passages 45 and into the hot gas stream 16 by way of openings on the axial sides, circumferential sides, or floor of the inner shroud body. It will be appreciated that with the foregoing arrangement, the impingement openings 56 in the compartments 52 lie closely spaced to the wall 42 of the inner shroud bodies for efficient impingement air cooling. That is, the distance between the bottom walls 60 of the compartments 52 and the floors 64 is minimal to maximize the cooling effect of the impingement air flow. The inner shroud body is also structurally maintained by the arrangement of the ribs 46 and 48.

Figure 2:
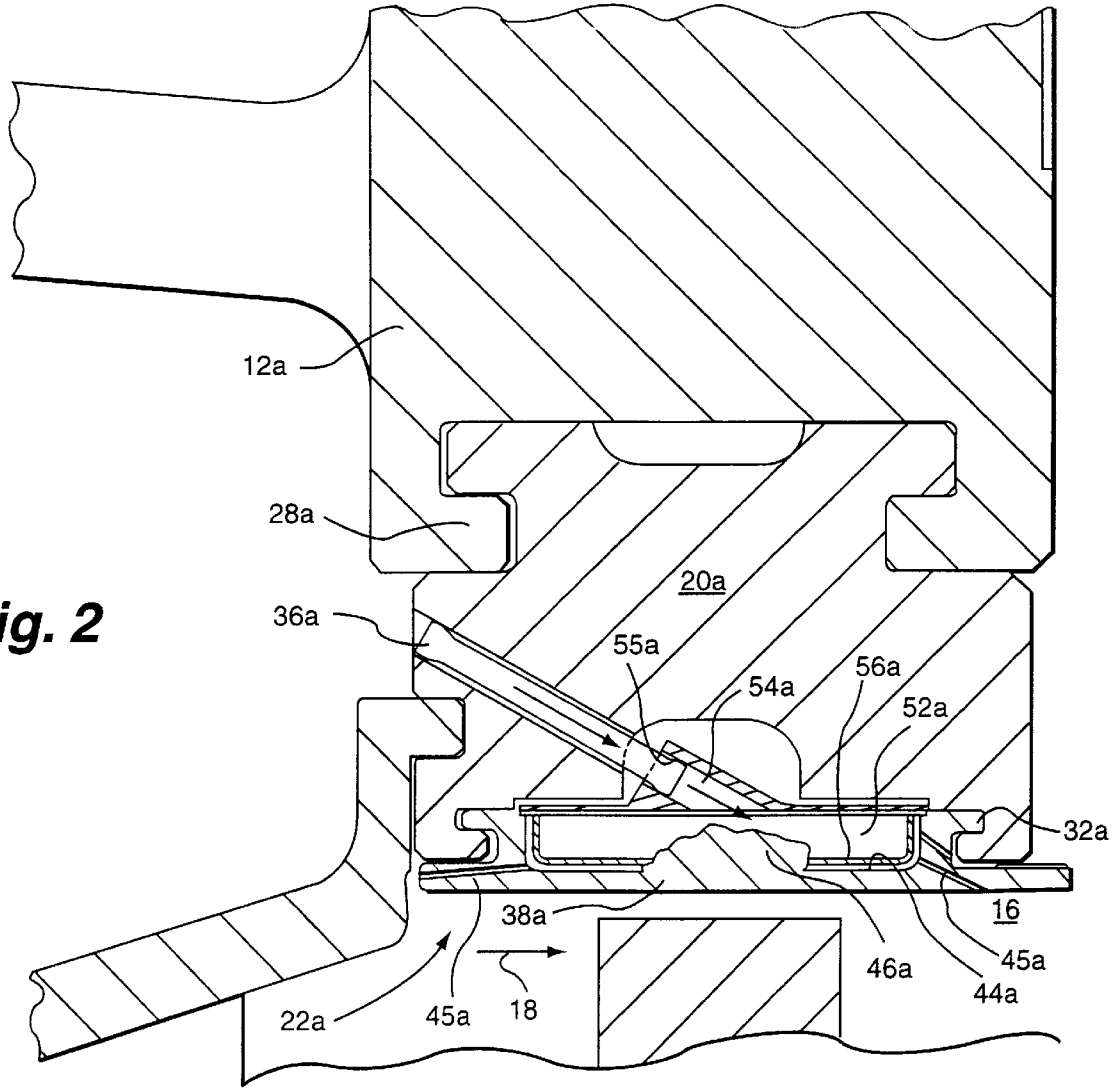
FIG. 2 is a view similar to FIG. 1 illustrating a shroud system according to the present invention for use in the second stage of the turbine.

Referring to FIG. 2, which illustrates a further embodiment of the present invention for shroud impingement cooling particularly for use in the second stage of the turbine, like reference numerals apply to like parts, followed by the suffix "a.: In this form of the invention, however, the inner shroud body 38*a* includes two compartments 52*a* circumferentially spaced one from the other, with an axially extending rib 46*a* between the compartments. The impingement cooling on the inner shroud wall is accomplished similarly as previously described. For example, the impingement cooling flow is supplied to the spoolie 36*a*, which in turn supplies the air to plenum 54*a* via inlet 55*a* and compartments 52*a*. The cooling air flows through the impingement apertures 56*a* of compartments 52*a* for impingement cooling against the floors of the cavities 44*a*, thus cooling the radially innermost wall of the inner shroud body 38*a*. The spent cooling air flows out of the cavities 44*a* through forward and aft passages 45*a*.

It will be appreciated that the inner shroud body may include only one cavity 44 formed in the radially outermost wall thereof, with exit openings along forward and aft walls and/or side walls for flowing spent cooling air through the exit openings for egress into the hot gas path. In this instance, the inner shroud body cover carries a single depending compartment which lies in communication with the plenum at the inner end of the spoolie. As in the previous embodiments, the compartment has a plurality of apertures through bottom walls spaced closely adjacent the radially outer wall of the inner shroud body for flowing impingement cooling air against the latter wall. The spent cooling air then flows through the forward and aft and/or side openings for egress into the hot gas stream. It will also be appreciated that the spent cooling impingement air may flow into the hot gas stream through openings, for example, openings 64 illustrated in FIG. 4, through the radially innermost floor of the cavities 44, i.e., the wall defining the hot gas path.

By using spoolies 36, the flow of cooling air to the shrouds can be altered, for example, during an engine retrofit. For example, the size of the spoolie can be changed to admit additional cooling air if the engine is running too hot or to limit the flow of cooling air if the cooling effect is too substantial.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Impingement cooling apparatus for a shroud system surrounding components rotatable about an axis in the hot gas path of a turbine, comprising:

a shroud segment forming part of a shroud for surrounding the rotating components of the turbine, said shroud segment including a shroud segment body having a circumferentially extending wall, in part, defining the hot gas path, a plurality of cavities on a side of said segment body remote from the hot gas path and a cover for said shroud segment body having a cooling air inlet and a plurality of radially inwardly projecting compartments in communication with said air inlet and received in said cavities, respectively;

each said compartment having a bottom wall in spaced registration with the wall of said segment body and having a plurality of impingement apertures opening therethrough for flowing impingement cooling air from said compartments through said apertures and against said segment body wall for cooling said segment body wall; and at least one passage through said segment body in communication with the space between said segment body wall and said bottom wall for flowing spent cooling air from said segment body.

2. Apparatus according to claim 1 wherein said compartments are closed for said inlet and said impingement apertures.

3. Apparatus according to claim 1 wherein said segment body includes a rib projecting radially outwardly of said segment wall dividing the segment body into at least two of said cavities.

4. Apparatus according to claim 3 wherein said compartments are separated from one another by a recess receiving said rib.

5. Apparatus according to claim 1 wherein said shroud segment body comprises a radially inner shroud segment body, said shroud segment including a radially outer shroud segment body, means for securing said outer and inner shroud segment bodies to one another, said outer shroud segment body including a passageway in communication with said inlet for flowing cooling air to said inlet.

6. Apparatus according to claim 5 wherein said cover is secured to said inner shroud body.

7. Impingement cooling apparatus for a shroud system surrounding components rotatable about an axis in the hot gas path of a turbine, comprising:

an inner shroud segment forming part of the shroud system for surrounding the rotating components of the turbine, said inner shroud segment including an inner shroud body having a circumferentially and axially extending wall defining in part the hot gas path, at least four cavities formed in the inner shroud body on a side thereof remote from the hot gas path with radial innermost portions of the cavities formed by portions of the inner shroud body wall and a cover having a cooling air inlet and a plurality of radially inwardly projecting closed compartments in communication with said inlet for receiving cooling air, said compartments being received in said cavities, respectively, said compartments having bottom walls in spaced registration with said inner shroud body wall portions and a plurality of impingement apertures through each of said bottom walls for flowing impingement cooling air from said compartments against said inner shroud body wall portions for cooling said shroud body wall, and at least one passage in communication with each of said cavities and opening externally of said inner shroud body for flowing spent cooling air from said cavities.

8. Apparatus according to claim 7 wherein said inlet for said cover includes a plenum in communication with each of said compartments.

9. Apparatus according to claim 7 wherein each said compartment includes side walls and a plurality of apertures through at least one wall of each compartment for flowing impingement cooling air into said cavities.

10. Apparatus according to claim 7 wherein said inner shroud body includes at least one structural rib projecting radially outwardly of said inner shroud body wall and said cover includes at least one recess between said cavities for receiving said one rib.

11. Apparatus according to claim 7 wherein said inner shroud body includes a pair of mutually perpendicular structural ribs projecting radially outwardly of said inner shroud body wall and in part defining said cavities, said cover including a pair of mutually perpendicular recesses between said compartments for receiving said pair of ribs, respectively.

12. Apparatus according to claim 7 including an outer shroud segment having an outer shroud body, said inner and outer shroud segment bodies having complementary flanges and locating hooks for securing said bodies to one another.

13. Apparatus according to claim 12 wherein said outer shroud segment body includes a passage and a spoolie in said passage for flowing cooling air to said inlet of said cover.

14. Impingement cooling apparatus for a shroud system surrounding components rotatable about an axis in the hot gas path of a turbine, comprising:

an inner shroud segment forming part of the shroud system for surrounding the rotating components of the turbine, said inner shroud segment including an inner shroud body having a circumferentially and axially extending wall defining in part the hot gas path, at least one cavity formed in the inner shroud body on a side thereof remote from the hot gas path and opening radially outwardly, radial innermost portions of said one cavity being formed by portions of the inner shroud body wall, and a cover having a cooling air inlet and at least one radially inwardly projecting closed compartment in communication with said inlet for receiving cooling air, said one compartment being received in said one cavity, said one compartment having a bottom wall in spaced registration with said inner shroud body wall portions and a plurality of impingement apertures through said bottom wall for flowing impingement cooling air from said one compartment against said inner shroud body wall portions for cooling said shroud body wall, and at least one passage in communication with said cavity and opening externally of said inner shroud body for flowing spent cooling air from said cavity.

15. Apparatus according to claim 14 wherein said compartment includes side walls and a plurality of apertures through at least one side wall of said compartment for flowing impingement cooling air into said cavity.

16. Apparatus according to claim 14 including an outer shroud segment having an outer shroud body, said inner and outer shroud segment bodies having complementary flanges and locating hooks for securing said bodies to one another.

17. Apparatus according to claim 16 wherein said outer shroud segment body includes a passage and a spoolie in said passage for flowing cooling air to said inlet of said cover.

18. Apparatus according to claim 14 including openings through said circumferentially and axially extending wall for flowing spent cooling air from said cavity directly into the hot gas stream.

* * * * *

UNITED STATES PATENT AND TRADEMARK OFFICE

CERTIFICATE OF CORRECTION

PATENT NO. : 6,126,389
DATED : October 3, 2000
INVENTOR(S) : BURDGICK

It is certified that error appears in the above-identified patent and that said letters patent is hereby corrected as shown below:

Column 1, after the heading "Technical Field," insert --This invention was made with Government support under Contract No. DE-FC21-95MC31176 awarded by the Department of Energy. The Government has certain rights in this invention.--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,126,389
APPLICATION NO. : 09/145683
DATED : October 3, 2000
INVENTOR(S) : Burdgick It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Column 1, after the heading "Technical Field," insert --This invention was made with Government support under Contract No. DE-FC21-95MC31176 awarded by the Department of Energy. The Government has certain rights in this invention.--.

Signed and Sealed this

Twenty-fifth Day of March, 2008

JON W. DUDAS
*Director of the United States Patent and Trademark Office*